US007066360B2

(12) United States Patent
Hearld et al.

(10) Patent No.: US 7,066,360 B2
(45) Date of Patent: Jun. 27, 2006

(54) PUSH-PULL CONTAINER CLOSURE

(75) Inventors: Coy Hearld, Crawfordsville, IN (US); Ramesh Kamath, Crawfordsville, IN (US)

(73) Assignee: Alcoa Closure Systems International, Crawfordsville, IL (US)

( * ) Notice: Subject to any disclaimer, the term of this patent is extended or adjusted under 35 U.S.C. 154(b) by 314 days.

(21) Appl. No.: 10/701,847

(22) Filed: Nov. 5, 2003

(65) Prior Publication Data

US 2005/0092785 A1 May 5, 2005

(51) Int. Cl.
*B65D 47/00* (2006.01)

(52) U.S. Cl. ..... 222/525; 222/559; 215/251; 220/221; 220/720

(58) Field of Classification Search ..... 222/525, 222/552, 524, 521, 559; 215/251, 252, 331, 215/334, 387; 220/221, 720
See application file for complete search history.

(56) References Cited

U.S. PATENT DOCUMENTS 3,599,845 A * 8/1971 Miller ..... 222/525
5,456,374 A * 10/1995 Beck ..... 215/251
5,472,120 A 12/1995 Stebick et al.
5,975,369 A * 11/1999 Yurkewicz et al. .... 222/153.06

* cited by examiner

*Primary Examiner*—David A. Scherbel
*Assistant Examiner*—Melvin A. Cartagena
(74) *Attorney, Agent, or Firm*—Wood, Phillips, Katz, Clark, & Mortimer

(57) ABSTRACT

A push-pull closure including a shell and a tip. The shell includes a body with a fluid opening, a stem extending axially through the opening, and a first lip on the body outer surface and a second lip on the body inner surface, with the lips facing the shell one end with the second lip being further from the shell one end than the first lip. The tip has a pouring aperture with an outer flange having an inwardly extending third lip receivable over the body outer surface and an inner flange having an outwardly extending fourth lip receivable in the body opening and spaced from the stem. The third lip is positioned between the shell one end and the first lip and the fourth lip is positioned between the shell one end and the second lip. The first lip has an outer diameter greater than the inner diameter of the third lip and the second lip has an inner diameter less than the outer diameter of the fourth lip.

13 Claims, 3 Drawing Sheets

PUSH-PULL CONTAINER CLOSURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward container closures, and particularly toward a push/pull type cap for liquid containing bottle.

BACKGROUND OF THE INVENTION AND TECHNICAL PROBLEMS POSED BY THE PRIOR ART

Many containers, particularly plastic bottles containing dispensing fluids (whether, e.g., drinkable liquids or cleaning fluids), have closures or caps which are twisted or pulled to open a passage for dispensing the liquid, and provide a seal to close the container and prevent leaking when not in use.

In one such conventional cap structure, a tip is slidable over a central stem on the shell of the cap, with the shell defining an opening around the stem for dispensing the fluid. A plastic tip is slidably secured over the stem and includes a central opening which seals around the stem to block fluid when the tip is pushed in, with the central opening being spaced from the stem to allow fluid to be dispensed around the stem and through the tip opening when the tip is pulled out. Closures of this type are shown, for example, in U.S. Pat. Nos. 5,472,120 and 5,975,369, the complete disclosures of which are hereby incorporated by reference.

The connection of the tip to the shell of the closure is particularly important for commercial acceptance of such closures. For example, it is important that the force required to push the tip to close the container, and to pull the tip to open the container when releasing, be within acceptable ranges. Consumers will not accept caps which are too difficult to push closed or pull open. At the same time, caps which open too easily are also undesirable in that they may be unintentionally opened and leak liquid from the container. Still further, it is important that the cap be capable of being easily assembled while at the same time have its components sufficiently secured together so that the possibility of them coming apart (and essentially destroying the usefulness of the cap) is minimized. Secure retention of the movable tips of such caps can be particularly difficult to provide given that the tip of such caps can be subjected to many different forces, including not only axially directed loads such as used to the tip open, but also side and twisting loads. Side loads can be particularly large when, for example, a user bites on the tip during use (e.g., when drinking from the container) as is not uncommon.

The present invention is directed toward overcoming one or more of the problems set forth above.

SUMMARY OF THE INVENTION

According to various aspects and forms of the present invention, a push-pull closure may be provided which is both aesthetically and functionally desirable. The closure may be easily assembled, while at the same time providing a tip which may be opened and closed with desirable pull and push forces, and further while ensuring that the tip will be reliably maintained on the closure shell notwithstanding the wide range of axial and lateral or side forces to which it may be subjected during use.

In one aspect of the present invention, a push-pull closure is provided, including a shell and a tip. The shell is attachable on one end to a container, and includes a body with a fluid opening, a stem in the opening, and a first lip on the body outer surface and a second lip on the body inner surface, with the lips facing the shell one end. The tip has a pouring aperture at one end and an outer flange receivable over the body outer surface and an inner flange receivable in the body opening and spaced from the stem to define a generally annular fluid path therebetween. The outer flange includes an inwardly extending third lip, and the inner flange includes an outwardly extending fourth lip. The third lip is positioned between the shell one end and the first lip and the fourth lip is positioned between the shell one end and the second lip whereby the first lip engages the third lip and the second lip engages the fourth lip to prevent removal from the tip from the shell body.

In one form of this aspect of the invention, the body outer surface is cylindrical, and the first lip extends around the outer cylindrical surface. In a further form, the third lip is elastically biased against the body outer surface, and the body outer surface tapers outwardly from the first lip toward the shell one end.

In another form of this aspect of the invention, the lips are ring shaped with inner and outer diameters, with the first lip having an outer diameter greater than the inner diameter of the third lip and the second lip having an inner diameter less than the outer diameter of the fourth lip.

In still another form of this aspect of the invention, the stem extends axially through the body opening, and the first and second lips are axially spaced. In further advantageous forms, the third and fourth lips are axially spaced a distance which is substantially the same as the axial spacing between the first and second lips, the first lip is nearer the shell one end than the second lip, and/or the first and second lips define stop surfaces facing the shell one end with the stop surfaces being substantially transverse to the axial direction.

In yet another form of this aspect of the invention, the fourth lip slidably seals against the body inner surface around the entirety of the body opening.

In another aspect of the present invention, a closure is provided including a shell and a tip. The shell is attachable on one end to a container, and includes a body with a fluid opening, a stem extending axially through the opening, and a first lip on the body outer surface and a second lip on the body inner surface, with the lips facing the shell one end with the second lip being further from the shell one end than the first lip. The tip has a pouring aperture at one end and an outer flange receivable over the body outer surface and an inner flange receivable in the body opening and spaced from the stem to define a generally annular fluid path therebetween. The outer flange includes an inwardly extending third lip, and the inner flange includes an outwardly extending fourth lip. The lips are ring shaped with inner and outer diameters, with the third lip positioned between the shell one end and the first lip and the fourth lip positioned between the shell one end and the second lip. The first lip has an outer diameter greater than the inner diameter of the third lip and the second lip has an inner diameter less than the outer diameter of the fourth lip, whereby the first lip engages the third lip and the second lip engages the fourth lip to prevent removal from the tip from the shell body.

In one form of this aspect of the invention, the first and second lips define stop surfaces facing the shell one end with the stop surfaces being substantially transverse to the axial direction.

DETAILED DESCRIPTION OF THE INVENTION

Figure 1:
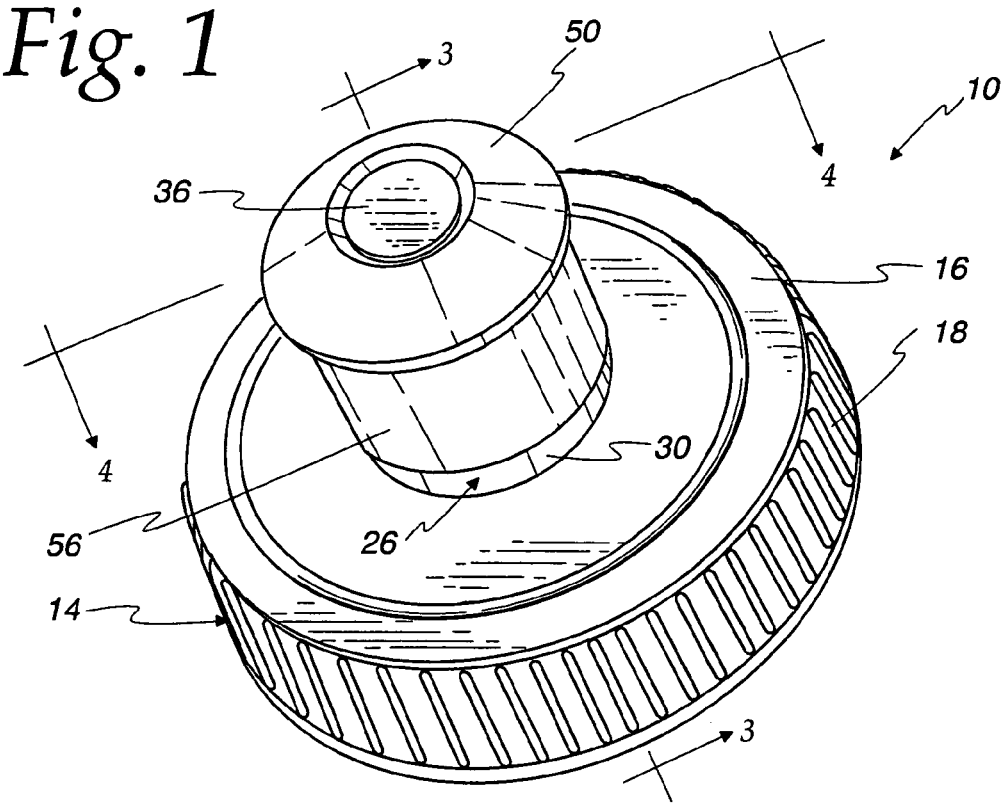
FIG. 1 is a perspective view of a push-pull closure according to the present invention, with the closure in a closed position.

A push-pull closure 10 embodying the present invention is shown in FIG. 1. The closure 10 includes a shell 14 adapted to attach to the opening of a container, as by a cap portion 16 having an outer cylindrical wall 18 with an inner thread 20 adapted to mate with a threaded portion on a container.

The shell 14 includes a central opening 24 surrounded by an annular body 26 defining generally cylindrical inner and outer walls or surfaces 28, 30. A stem 36 is supported within the annular body 26, as by radial legs 38 (see FIGS. 4–7), so as to extend axially through the body 26 and define a generally cylindrical flow path 40 around the stem 36. Openings may be provided through the legs 38 if desired to permit greater fluid flow from the container to the flow path 40.

The annular body 26 includes an outwardly extending lip or fang 44 on the outer wall 30 and an inwardly extending lip or fang 46 on the inner wall 28. These lips 44,46 are generally cylindrical or ring shaped and define surfaces which face the cap portion 16 and extend radially in a direction generally transverse to the axial direction. The lips 44, 46 are also spaced from each other in the axial direction a selected distance, with the outwardly extending lip 44 nearer the cap portion 16 than the inwardly extending lip 46.

A push-pull tip 50 includes a pouring aperture 52 at one end, with inner and outer flanges 54,56 extending axially from that end. The inner flange 54 fits inside the shell annular body 26, and the outer flange 56 fits around the outer wall 30 of the annular body.

An inwardly extending lip or fang 60 is provided around the inside of the tip outer flange 56 and an outwardly extending lip or fang 62 is provided around the outside of the tip inner flange 54. The lips 60, 62 may be advantageously spaced from each other in the axial direction the same selected distance as the spacing between the annular body lips 44, 46. Further, the inner flange lip 62 slidably seals against the body inner wall 28 around the entirety of the flow path 40 to ensure that little fluid in the path 40, if any, leaks between the inner flange 54 and the annular body 26. Such a seal may be provided by elastic compression of the materials between the engaging components.

As assembled, the tip lips 60, 62 are positioned between the cap portion 16 and the annular body lips 44, 46. This may be accomplished by pressing the tip 50 over the annular body 26, with compression of the materials and/or bending of the flanges 54, 56 will allow the tip lips 60, 62 to be moved past the upper portion of the shell annular body 26 and the annular body lips 44, 46. Such an assembly may be facilitated by the spacing of the lips 44, 46 and 60, 62, as it should be appreciated that the tip lips 60, 62 will therefore not be required to be simultaneously forced over any thick portion of the annular body 26.

Once so assembled, the lips 44,46, 60, 62 will cooperate to retain the tip 50 on the shell 14, with lip 44 engaging lip 60 and lip 46 engaging lip 62 when the tip 50 is pulled to its limit of travel as described further hereafter. That is, the lips 44, 46, 60, 62, which are generally ring shaped with inner and outer diameters, have an interference overlap, with the annular body outwardly extending lip 44 having an outer diameter greater than the inner diameter of the inwardly extending tip lip 60 and the annular body inwardly extending lip 46 having an inner diameter less than the outer diameter of the outwardly extending tip lip 62.

It should be recognized that the lips 44, 46, 60, 62 need not be completely continuous, and thus can be formed with breaks in their annular shape. Thus, for example, mold components may be used which may make it difficult to form the annular body lips 44, 46 through a full 360 degrees (e.g., mold components used to form the legs 38 may block mold components necessary to form the annular body inner lip 46 in axial alignment with the legs 38, in which case the inwardly projecting lip 46 would not be seen in FIGS. 4–6). Nevertheless, a sufficient extent of the lips may be readily molded in order to create the necessary overlap between lips 44, 46, 60, 62 to provide the desired securement between the shell annular body 26 and the tip 50.

Figure 2:
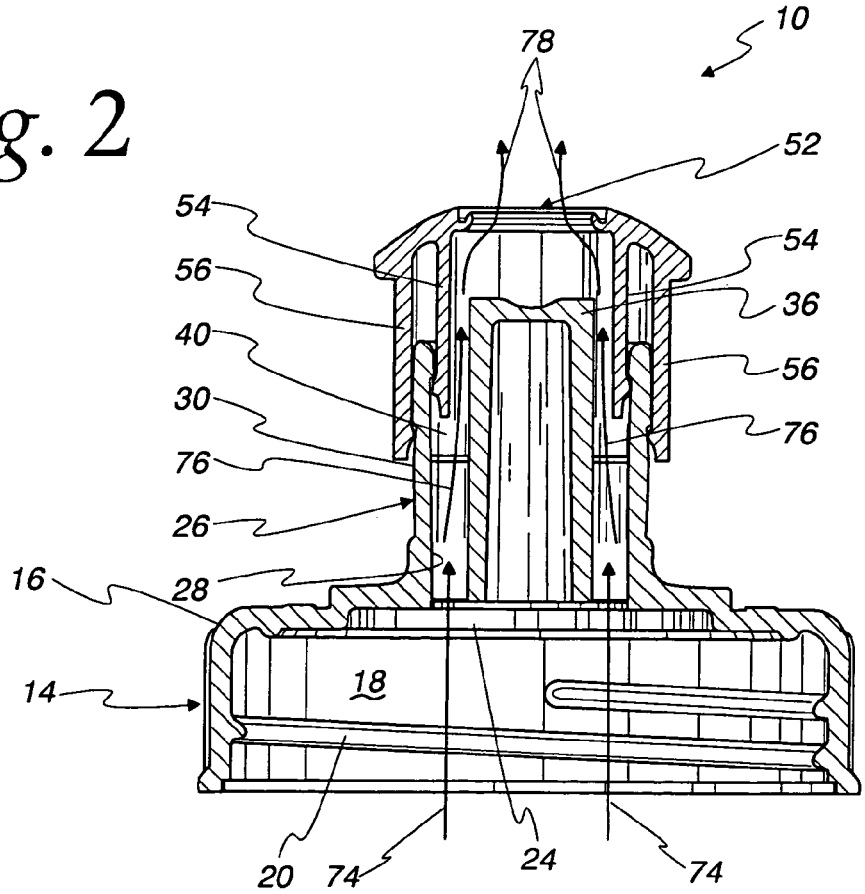
FIG. 2 is a cross-sectional view taken through the closure of FIG. 1, with the closure tip in an open position.
Figure 3:
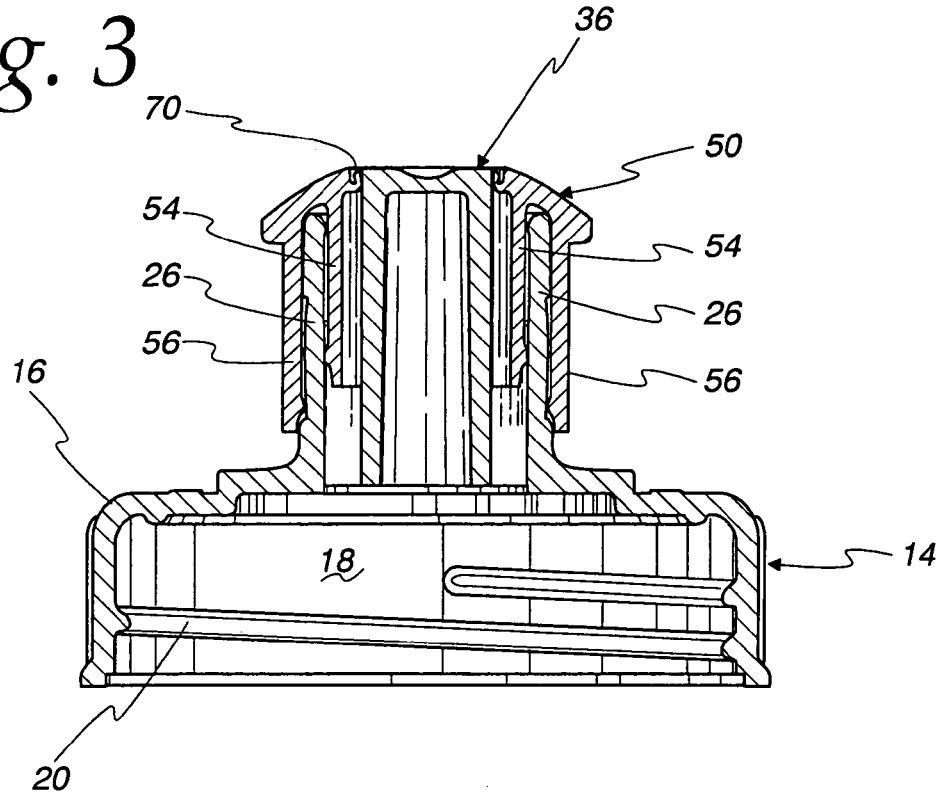
FIG. 3 is a cross-sectional view taken along line 3—3 of FIG. 1.
Figure 4:
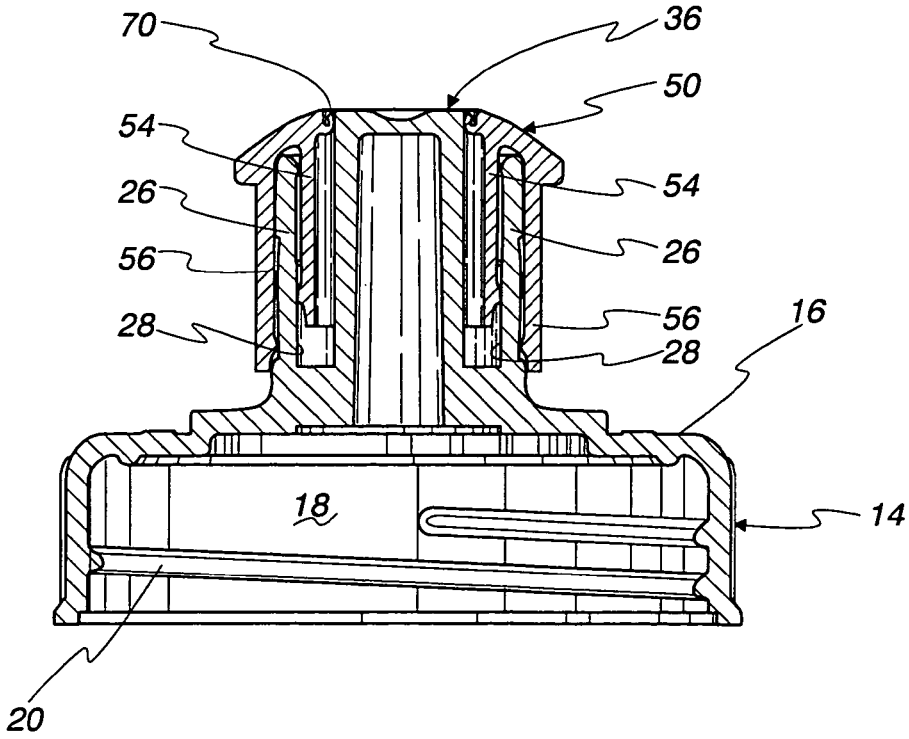
FIG. 4 is a cross-sectional view taken along line 4—4 of FIG. 1.

A sealing member 70 is provided around the pouring aperture 52, and is adapted to seal around the stem 36 when the tip 50 is in the closed position, as shown in FIG. 3. When the tip 50 is in its open position as shown in FIG. 2, fluid such as a sports drink can flow, from a container through the cap portion 16 (arrows 74) and the cylindrical flow path 40 around the stem 36 (arrows 76), then out through the pouring aperture 52 (arrows 78).

Figure 5:
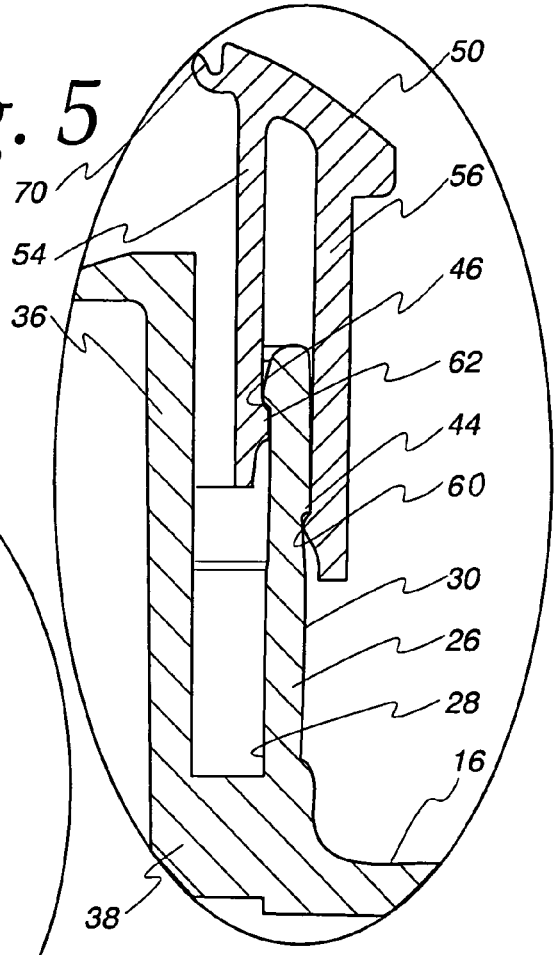
FIG. 5 is an enlarged view similar to FIG. 4, but showing the securement of the closure tip to the shell in its open position.
Figure 6:
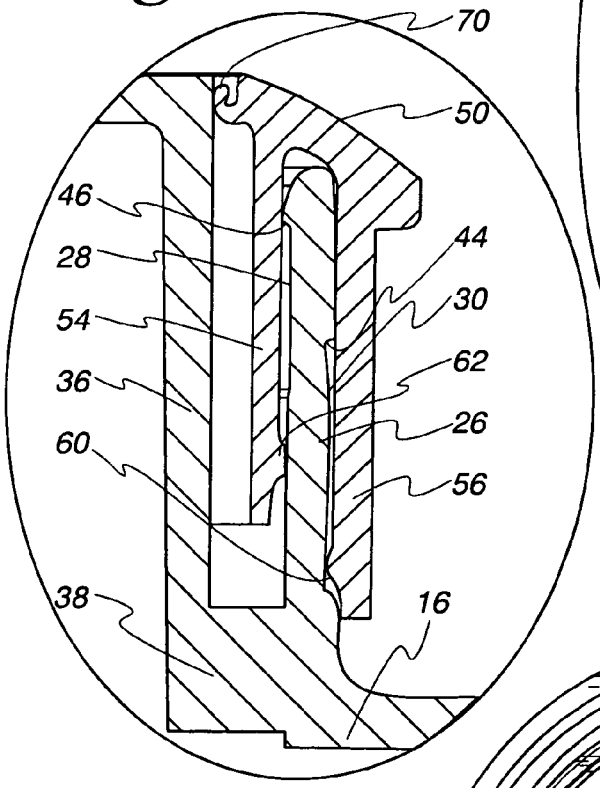
FIG. 6 is similar to FIG. 5, but with the closure tip in a closed position.
Figure 7:
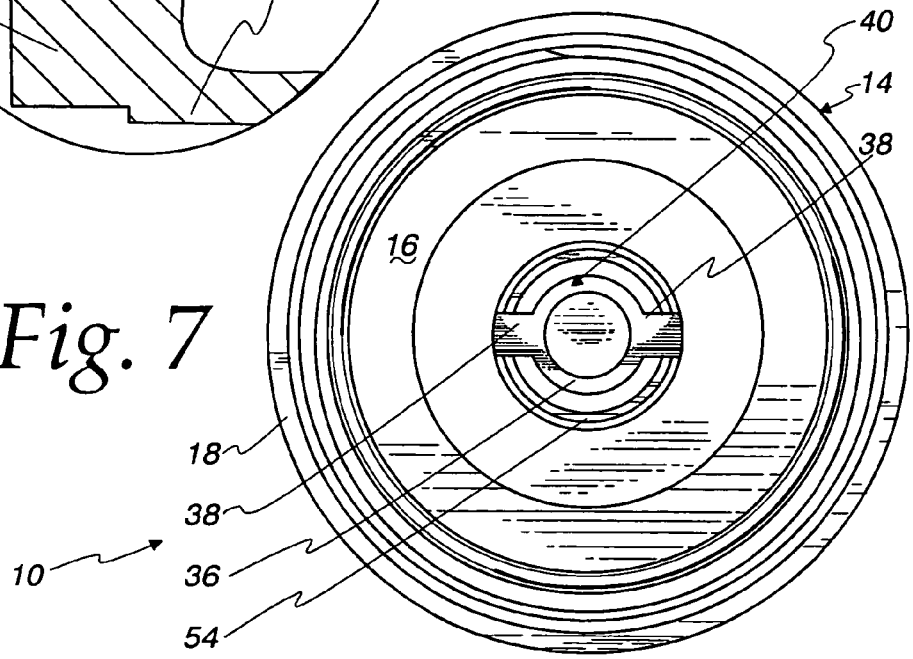
FIG. 7 is a bottom view of the closure of FIG. 1.

As best illustrated in FIGS. 5 and 6, the inner and/or outer walls 28, 30 of the shell annular body 26 may be slightly tapered outwardly from the lips 44, 46 toward the cap portion 16. As a result, when the tip 50 is pulled out toward the open position, there may be a detectable lessening of the required pull force as the tip 50 approaches the limit where the lips 44, 46, 60, 62 will engage to stop the tip 50 from being removed further (as shown in FIG. 5). That is, the compression forces between the tip lips 60, 62 and the annular body inner and outer walls 28, 30 will reduce, and therefore the axial friction between the lips 60, 62 and the walls 28, 30 will similarly reduce. Such a positive feel may have the benefit of causing the person pulling the tip 50 to reduce their pulling force, and thereby assist in otherwise ensuring that the tip 50 will be securely retained on the shell annular body 26 when the stop limit is reached. However, it would be within the scope of the present invention for the inner and outer walls 28, 30 to be straight in cross section to provide a uniformly shaped surface for the tip lips 60, 62 to slide over between open and closed positions.

Further, it should be appreciated that the described structure in which axially spaced inner and outer lips 62, 60 slidably engage inner and outer walls 28, 30 of the shell annular body 26 provides not only a firm axial positioning of the tip 50 as it is pushed and pulled over the annular body 26 (minimizing twisting off axis), but this also assists in enabling the consumer important push-pull force to be controlled. That is, since a significant amount of the required push-pull force is based on the friction between the tip 50 and the annular body 26, and since that friction is largely based largely on the frictionally engaging surfaces, control of such friction is relatively easy with the present invention inasmuch as the lips can be maintained in a fully engaging position throughout the full range of push-pull motion of the tip 50 (i.e., contacting surfaces, and thus frictional forces, do not significantly reduce notwithstanding the reduction in overlapping between the tip 50 and the annular body 26 as the tip 50 is pulled out).

Moreover, not only does the present invention provide for a secure mounting of the tip 50 to the annular body 26 against pull forces on the tip 50, but it also provides for a secure mounting against other forces such as side pull off forces which can also be encountered (e.g., when a user bites on the tip 50 during use). The provision of such a secure mounting against all such forces is functionally and commercially desirable.

The present invention as described thus provides a closure which is aesthetically desirable, can provide desired flow through the closure when opened, and which can be easily assembled while at the same time providing an easy to use push-pull closure for a sports bottle. Moreover, this advantageous closure provides a push-pull tip which is securely maintained on the closure shell notwithstanding the wide range of forces to which it may be subjected during use.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention cliamed is:

1. A closure comprising:

a shell attachable on one end to a container, and including a body attachable to a container opening, said body including an outer surface and an inner surface, wherein said inner surface defines an opening in fluid communication with the container opening when attached thereto, a stem positioned within said body opening to define a generally cylindrical fluid path between said body inner surface and said stem, an outwardly extending first lip on said body outer surface, said first lip facing said shell one end, and an inwardly extending second lip on said body inner surface, said second lip facing said shell one end; and a tip having a pouring aperture at one end, an outer flange receivable over said body outer surface and including an inwardly extending third lip, and an inner flange receivable in said body opening and spaced from said stem to define a generally annular fluid path therebetween, said inner flange further including an outwardly extending fourth lip, said third lip being positioned between said shell one end and said first lip and said fourth lip being positioned between said shell one end and said second lip whereby said first lip engages said third lip and said second lip engages said fourth lip to prevent removal from said tip from said shell body.

2. The closure of claim 1, wherein said first, second, third and fourth lips are each continuous.

3. The closure of claim 1, wherein said body outer surface is cylindrical, and said first lip extends around the outer cylindrical surface.

4. The closure of claim 3, wherein said third lip is elastically biased against said body outer surface, and said body outer surface tapers outwardly from said first lip toward said shell one end.

5. The closure of claim 1, wherein lips are ring shaped with inner and outer diameters, said first lip having an outer diameter greater than the inner diameter of said third lip and said second lip having an inner diameter less than the outer diameter of the fourth lip.

6. The closure of claim 1, wherein said stem extends axially through said body opening, and said first and second lips are axially spaced.

7. The closure of claim 6, wherein said third and fourth lips are axially spaced a distance which is substantially the same as the axial spacing between said first and second lips.

8. The closure of claim 6, wherein said first lip is nearer said shell one end than said second lip.

9. The closure of claim 6, wherein said first and second lips define stop surfaces facing said shell one end, said stop surfaces being substantially transverse to said axial direction.

10. The closure of claim 1, wherein said fourth lip slidably seals against said body inner surface around the entirety of said body opening.

11. A closure comprising:

a shell attachable on one end to a container, and including a body attachable to a container opening, said body including a cylindrical outer surface and an inner surface, wherein said inner surface defines an opening in fluid communication with the container opening when attached thereto, a stem extending axially through said body opening to define a generally cylindrical fluid path between said body inner surface and said stem, an outwardly extending first lip on said body outer surface, said first lip facing said shell one end, and an inwardly extending second lip on said body inner surface and axially spaced from said first lip, said second lip facing said shell one end and being further from said shell one end than said first lip; and a tip having a pouring aperture at one end, an outer flange receivable over said body outer surface and including an inwardly extending third lip, and an inner flange receivable in said body opening and spaced from said stem to define a generally annular fluid path therebetween, said inner flange further including an outwardly extending fourth lip, said fourth lip being axially spaced from said third lip a distance which is substantially the same as the axial spacing between said first and second lips, said third lip being positioned between said shell one end and said first lip and said fourth lip being positioned between said shell one end and said second lip;

said lips being ring shaped with inner and outer diameters with said first lip having an outer diameter greater than the inner diameter of said third lip and said second lip having an inner diameter less than the outer diameter of the fourth lip, whereby said first lip engages said third lip and said second lip engages said fourth lip to prevent removal from said tip from said shell body.

12. The closure of claim 11, wherein said first and second lips define stop surfaces facing said shell one end, said stop surfaces being substantially transverse to said axial direction.

13. The closure of claim 11, wherein said first, second, third and fourth lips are each continuous.

* * * * *

UNITED STATES PATENT AND TRADEMARK OFFICE

CERTIFICATE OF CORRECTION

PATENT NO. : 7,066,360 B2
APPLICATION NO. : 10/701847
DATED : June 27, 2006
INVENTOR(S) : Coy Hearld and Ramesh Kamath It is certified that error appears in the above-identified patent and that said Letters Patent is hereby corrected as shown below:

Title page, Item (73) should read: Alcoa Closure Systems International, Inc.
Crawfordsville, IN (US)

Signed and Sealed this

Third Day of October, 2006

JON W. DUDAS
*Director of the United States Patent and Trademark Office*